United States Patent [19]

Gallardo

[11] Patent Number: 4,631,862

[45] Date of Patent: Dec. 30, 1986

[54] SECURITY WINDOW GRATINGS WITH SAFETY LOCKS

[76] Inventor: Mike Gallardo, 16829 E. 14th St., San Leandro, Calif. 94578

[21] Appl. No.: 629,207

[22] Filed: Jul. 9, 1984

[51] Int. Cl.[4] ..... E06B 3/68

[52] U.S. Cl. ..... 49/56; 292/162; 292/302

[58] Field of Search ..... 49/56, 141; 292/156–162, 302

[56] References Cited

U.S. PATENT DOCUMENTS

| | | | |
|---|---|---|---|
| 58,548 | 10/1866 | Kast | 292/156 |
| 250,592 | 12/1881 | Smith | 49/56 |
| 1,259,397 | 3/1918 | Hathaway | 292/302 |
| 1,640,394 | 8/1927 | Crowley | 292/162 |
| 1,764,950 | 6/1930 | Griner | 292/302 |
| 2,718,039 | 9/1955 | Dube | 292/157 X |
| 3,921,334 | 11/1975 | Black, Sr. | 49/56 |
| 4,019,281 | 4/1977 | Weiler | 292/162 X |
| 4,055,360 | 10/1977 | Russi | 49/56 X |
| 4,070,048 | 1/1978 | Young | 49/141 X |
| 4,127,966 | 12/1978 | Schmidt | 49/141 |
| 4,249,345 | 2/1981 | Littleton | 49/56 |
| 4,263,747 | 4/1981 | Coltrin et al. | 49/56 |

FOREIGN PATENT DOCUMENTS

| | | | |
|---|---|---|---|
| 2045 | of 1884 | United Kingdom | 292/162 |

*Primary Examiner*—Peter A. Aschenbrenner

*Attorney, Agent, or Firm*—Linval B. Castle

[57] ABSTRACT

Security gratings covering windows of buildings are quickly and reliably opened only from the interior of the building by hinging the grating at a first end and having at the second end short end bars that extend through holes to the interior of the building. A locking bar vertically slideable in bushing members attached to the interior wall has hook portions that extend out and engage the end bars to prevent the grating to be hinged open. The lower end of the locking bars is locked against vertical movement by a quick release pin that engages the locking bar and a fixture attached to the wall near the floor and out of reach of an intruder reaching in the window. To open the grating it is only necessary to pull the pin and vertically move the locking bar to release its hooks from the ends of the end bars. Interior window gratings employ a similar vertically slideable locking bar having either upturned or downturned hooked sections extending out from the bar for engaging holes in flat end plates on the hinged grating. The locking bars are similarly locked against vertical movement by quick release pins.

4 Claims, 10 Drawing Figures

FIG. 7
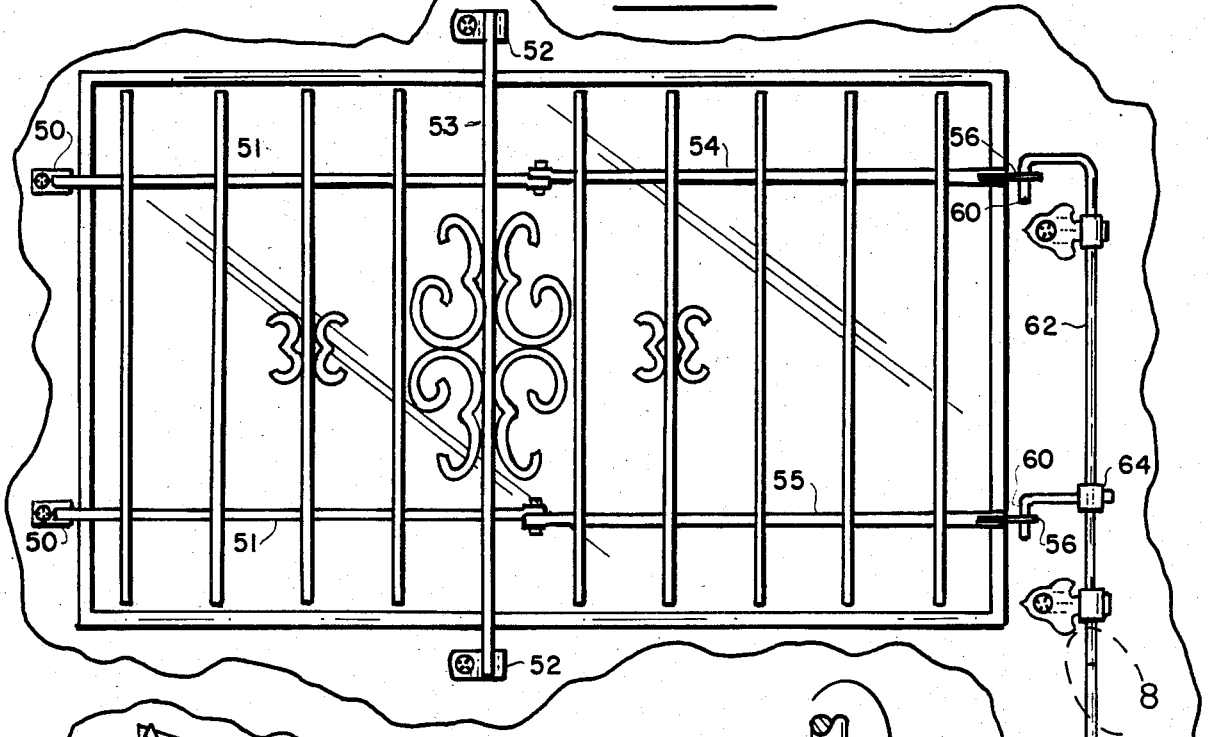
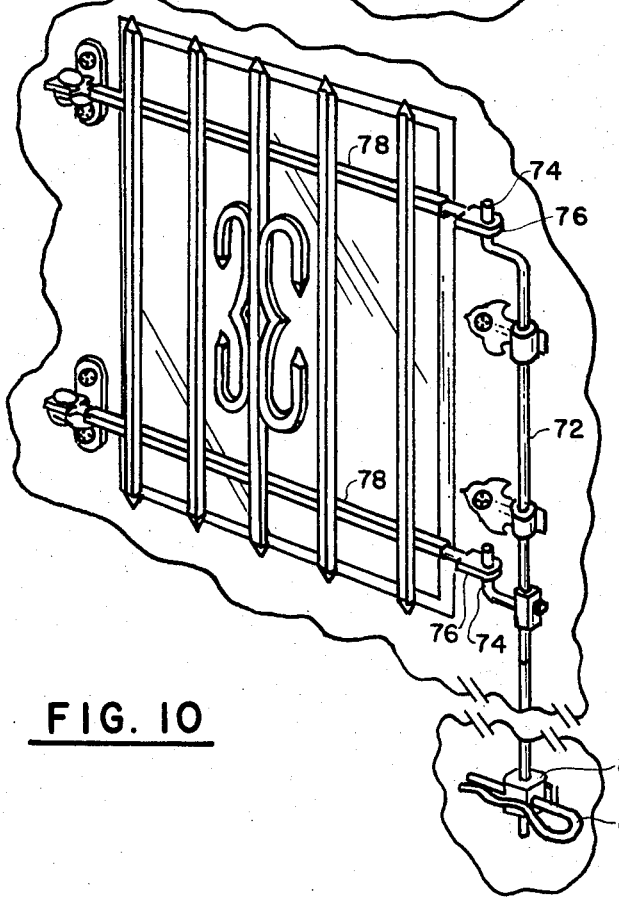
FIG. 10
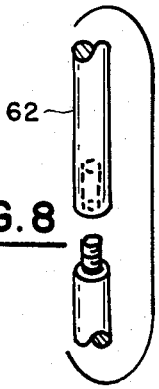
FIG. 8
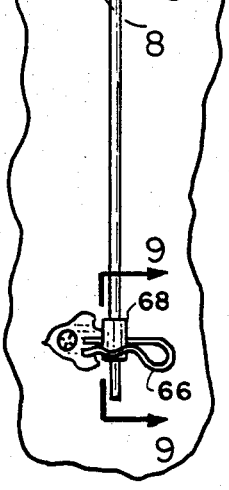
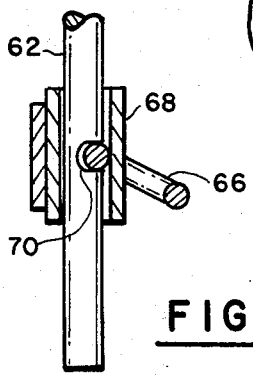
FIG. 9

SECURITY WINDOW GRATINGS WITH SAFETY LOCKS

BRIEF SUMMARY OF THE INVENTION

This invention relates to security gratings for windows and in particular to a safe, reliable and quick indoor release for such window gratings while providing complete security from ingression.

Ornamental window gratings of various designs are intended to both prevent intrusion and improve the exterior appearance of homes and business establishments and are a standard feature in Mediterranean architecture. The principal feature of window gratings, however, is that they provide security against intruders.

To provide security, the security gratings are often bolted to the exterior window frame, to exterior brick facings, or through the exterior building surfaces to studs or other vertical frame members in the buildings. The bolt heads must then be rounded or otherwise changed so that an intruder is unable to remove the grating to gain access through the window. Unfortunately, securing a window against intrusion in this manner also seals it against escape from within in cases of fire or other emergencies that may prevent escape through the normal exits.

An improvement over the fixed exterior grating is one which is hinged at one side to the building or window frame with the opposite side of the grating padlocked to a hasp firmly attached to the building or frame member. In this type of grating, the exterior is secured against entry, and if the padlock is accessible from the interior of the building, the grating may be released and hinged out for escape.

A further improvement in hinged security gratings eliminates the exterior hasp and lock and provides end bars that attach to the ends of the horizontal grating members on the side opposite the hinges and are bent at right angles to enter holes bored through the wall and into the interior of the building. The end bars are secured to prevent opening of the grating by individual inside latches operated by flexible cables connected to a foot pedal on the floor. Then by merely depressing the foot pedal, the latches release their hold on the ends of the end bars and the hinged grating may readily be puched out to provide escape.

While being a great improvement over the hasp and padlock gratings, the interior releasible gratings described above suffer some disadvantages. The first is that the two or more flexible cables between the floor pedal and the end bar latches must always be of equal length and tension so that, upon depressing the release foot pedal, all latches will simultaneously release the end bars. If one latch does not completely release, the grating cannot be opened. Another disadvantage is that an intruder, having knowledge of the type of latch in use, may break through the window behind the closed grating and reach around to pull on the release cables to open the grating from outside the building. Still another, but no less serious disadvantage, is that small children playing inside a home and near the release cables will often pull on them to release the grating without the knowledge of the parents, thereby eliminating their security advantages.

The security grating described and claimed herein cannot be opened from without even if the window behind the grating is removed. It cannot be opened by young children and cannot be partially released as with cables of unequal lengths.

Briefly describe, in one embodiment the security grating of the invention is firmly hinged to a building exterior at one side of the window with the ends of each of the horizontal grating members on the opposite side of the hinges loosely supporting end bars that extend through holes in the wall to the interior of the building. The interior ends of the end bars are firmly retained by a vertical locking rod having, for each end bar, a bifurcated hook that engages a depression near the end of the bar to thereby tightly engage the end bars. The vertical locking rod is conveniently hidden behind window drapes and is locked by a suitable pin at a point near the floor so that it is inaccessible to anyone attempting to reach through the grating. To open the grating, it is only necessary to remove the locking pin and release the locking rod's bifurcated hooks from the end bars. If the grating is to be mounted inside the building, the end bars for formed as flat plates having holes for engaging the hooked sections extending from the locking rod. These hooks may be upturned so that release is accomplished by merely pulling the quick release pin to vertically drop the locking rod, or may be downturned so that the locking rod must be raised to release it's hooks from the end bars on the grating.

BRIEF DESCRIPTION OF THE DRAWINGS

In the drawings which illustrate the preferred embodiment of the invention:

FIG. 7 is an elevational view of another embodiment of an ornamental security grating for indoor mounting;

FIG. 8 is a detail view taken along the lines 8—8 of FIG. 7;

FIG. 9 is a detail sectional view of the locking pin taken along the lines 9—9 of FIG. 7; and FIG. 10 is a perspective view of still another embodiment of an ornamental security grating for indoor mounting.

DETAILED DESCRIPTION

Figure 1:
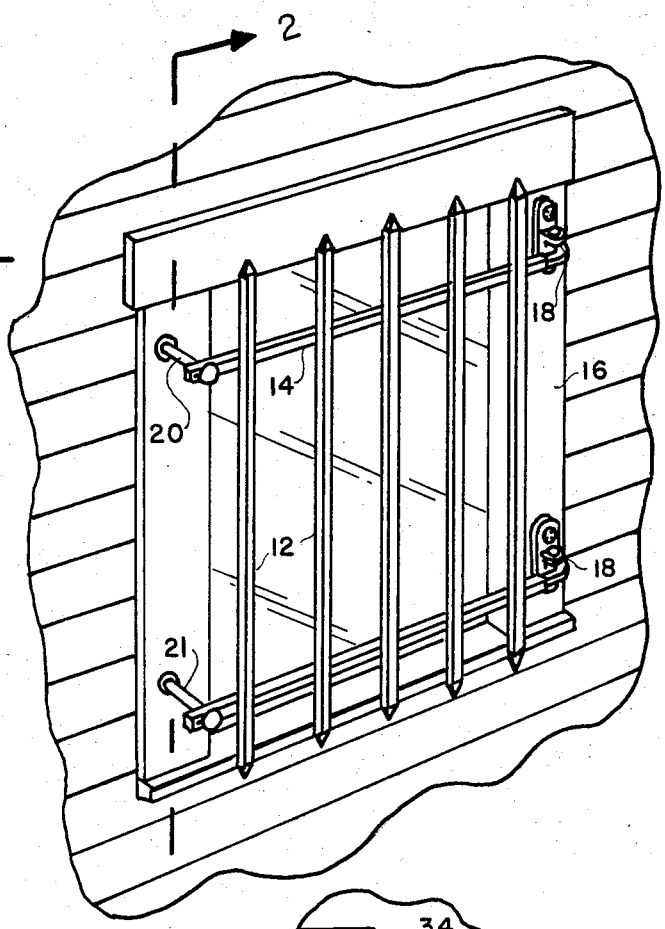
FIG. 1 is a perspective view illustrating an exterior security grating hinged to a window frame.

FIG. 1 is a perspective drawing illustrating a security grating comprising a plurality of vertical bars 12 of length corresponding generally to the height of the window or opening which is to be secured against intrusion. The vertical bars are substantially parallel and suitably spaced to prevent entry between adjacent bars.

The vertical bars 12 are preferably welded to two or more horizontal members 14, the number being dependent upon the height of the opening to be seoured and thus the spacing of the members 14. Each of the horizontal members 14 are pivotally connected to the opening's frame 16 by suitable hinges 18 that are connected to both the vertical members and the frame by suitable bolts or screws that cannot be removed with conventional tools. Therefore, the security grating is effectively permanently hinged over the window or opening.

Figure 3:
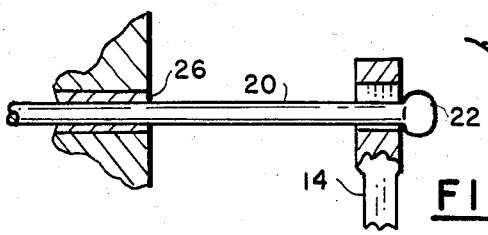
FIG. 3 is a sectional view taken along the lines 3—3 of FIG. 2 and illustrates in detail the end bar attachment to the horizontal grating member.

The grating is locked in a closed position over the window by end bars 20, 21 which are coupled to the ends of the horizontal members 14 opposite the hinges 18. The end bars 20 are of a smaller diameter than the width of the horizontal members 14 and have a ball or flanged outer end 22 so that when the end bars are loosely fitted through the elongated or slotted holes near the ends of the horizontal member, they cannot pass completely therethrough as best illustrated in the sectional view of FIG. 3.

Figure 2:
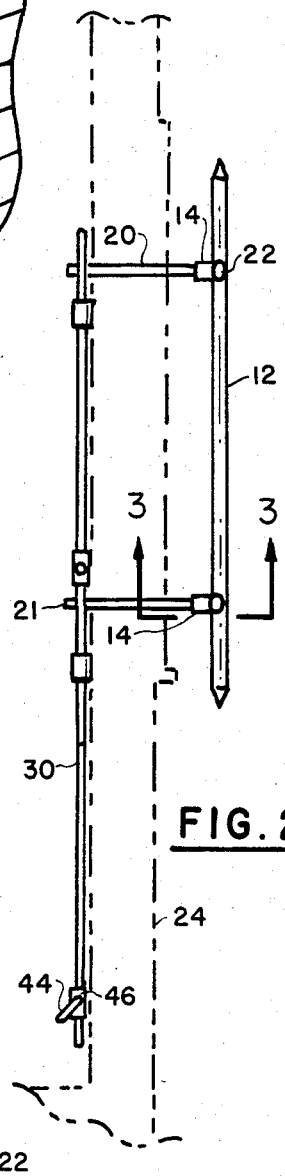
FIG. 2 is a edge view taken along the lines 2—2 of FIG. 1 and further illustrates the end bars passing through the building and the locking rod for securing the end bars.

As illustrated in FIG. 2, the end bars 20 are at right angles to the horizontal member 14 to which they are coupled and extend through holes through the building wall 24, illustrated by broken lines, and into the interior of the building. As shown in the detailed view of FIGS. 3 and 5, a guide bushing 26 having a flange 28 at the interior end is preferably inserted through the holes in the building wall to provide a smooth guide for its end rod 20, a finished interior wall, and a seal against drafts through the hole in the building wall.

Figure 4:
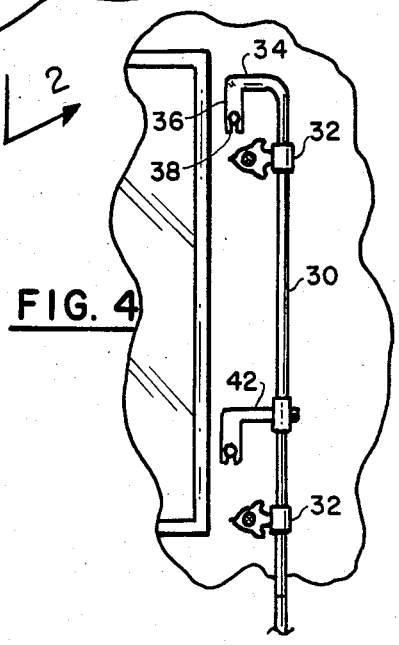
FIG. 4 is an elevation view of the locking rod.
Figure 5:
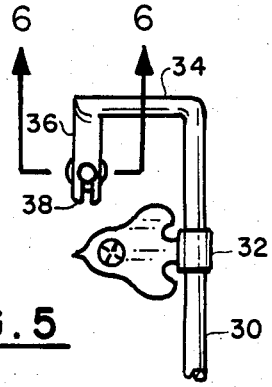
FIG. 5 is a sectional view taken along the lines 5—5 of FIG. 4.

The interior end of the end rods 20, and hence the exterior grating, is secured by a locking rod 30 as shown in FIGS. 2 and 4. The rod 30 is vertically and slideably mounted in ornamental bushings 32 attached to the interior wall of the building and adjacent the end rods 20 extending therethrough. The upper end of the locking rod 30 is bend into a hook 34 having a downward facing end portion 36 that is substantially parallel with the rod 30. The extreme end of the hook end portion 36 is bifurcated to form a fork 38 that engages a narrowed or notched section 40 near the inner end of the end rod 20 as best shown in FIG. 5. Thus, the weight of the locking rod 30 operates to maintain the fork 38 in the restriction 40 of the end rod and lock the exterior grating. The grating is unlocked so that it may be hinged outward by merely lifting the locking rod to disengage the bifurcated fork 38 from the end rod 20.

As shown in FIG. 4, a second hook 42, which is adjustably locked by a set screw to the locking rod 30, has a forked end that engages the notched sections near the end of the end bar 21. If the security grating is long and requires a third horizontal member and end bar, a third hook with bifurcated hook end may be secured to the locking rod 30.

To prevent an intruder from merely breaking through the window and lifting the locking rod 30 to thereby release the grating, the locking rod 30 is further secured by a loosely fitted quick release pin 44 that preferably extends through aligned holes in the lower end of the locking rod and in an ornamental bushing 46 mounted to the building wall near the floor and out of reach through the closed security grating, as shown in FIG. 2. Therefore, to release the grating so that it may be hinged open, it is only necessary to remove the quick release pin 44 and lift the locking rod 30 so that the forked ends of the hooks 34, 42 are released from the ends of the end bars 20.

FIG. 5 is a sectional view taken along the lines 5—5 of FIG. 4 and illustrates the pinched or notched section 40 which is engaged by the forked end of the locking rod.

Figure 6:
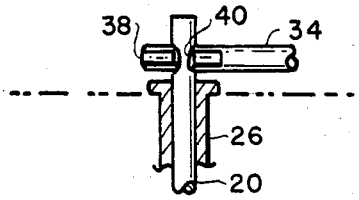
FIG. 6 is a detailed elevation view of a bifurcated hook on a locking rod that is released by lowering the rod.

FIG. 6 is a drawing illustrating the top end of a locking rod 31 having an upward turned hook 35 terminating in a bifurcated or forked end 439 that engages the notched portion of the end rod 48. In this embodiment, the grating is very rapidly released by merely withdrawing the quick release pin 44, shown in FIG. 2, and permitting the rod 31 to drop vertically downward to remove the forked end 39 from the notched section in the end rod.

FIG. 7 illustrates a second embodiment of a security grating for installation in the interior of a building. In this embodiment, a portion of the wide grating is permanently secured to the interior wall by mounting fixtures 50 connecting the horizontal grating members 51 to the window frame and second mounting fixtures 52 connecting a vertical bar 53 to the window header and sill. Horizontal members 54 and 55 in a second portion of the grating are pivotally coupled to the ends of the horizontal members 51 so that the second portion may be opened in toward the interior of the building. In this embodiment, the ends of the horizontal members 54, 55 opposite the pivots have end bars formed as horizontal plates 56 with each plate having a hole bored therethrough to accommodate a downward turned hook 60 in the end of a locking rod 62 and a second hook located on an adjustable member 64 locked on the rod 62. As with the embodiment illustrated in FIGS. 1–6, the locking bar 62 is secured by a pin 66 through aligned holes through the bar 62 and an ornamental bushing 68 mounted to the building wall and near the floor so that it cannot be reached from outside the closed grating.

FIG. 8 is a view taken along the area 8—8 in FIG. 7 and illustrates that the length of the locking rod may be adjusted or lengthed by forming it from shor tapped and threaded sections that may be interconnected to obtain the desired lengths.

FIG. 9 is a sectional view taken along the lines 9—9 of FIG. 7 and illustrates a means for locking the locking rod 62 against lifting and release of the grating. As shown, a slot 70 may be cut in the side of the rod and perpendicular to the longitudinal axis thereof. A locking pin 66 is inserted at the point at which the axis of the slot corresponds to the axis of a corresponding hole through the ornamental bushing 68 to thereby secure the rod 62 from being raised to release the hooks 60 and hence the grating.

FIG. 10 illustrates another embodiment substantially similar to that of FIG. 7 except that the locking bar 72 has upturned hooks 74 that engage holes in the flat plates 76 at the ends of the horizontal members 78 of the hinged grating. As with the other embodiments, the locking bar 72 is secured against vertical movement by a locking pin 80 through a diametric hole or slot near the bottom of the bar and a corresponding hole through a bushing 82 mounted to the building interior wall near the floor. The grating in this embodiment is very rapidly and reliably released by merely pulling the quick release pin 80 from the bushing 82 thus permitting the rod to drop through the bushings to the floor and thereby release all hooks 74 from the flat plates 76 and hence the grating.

It will be noted that all embodiments of the security grating that have been shown and described herein will prevent releasing of the locking bars securing the gratings from a position outside the building but permits easy and rapid release from within in cases of emergency. Because the locking bars are preferably of steel approximately ⅜ inches in diameter, small children cannot lift it accidentally to release the grating.

I claim:

1. A quick release security window grating locking and release apparatus located within the interior of a building, adjacent a window substantially covered by a rectangular security grating and below a normal reach of an intruder for the locking and the quick release of said grating, said grating having first and second end members, said first end members being hinged to a wall of the building, said locking and release apparatus including:

at least one end bar having the first end thereof secured at right angles to the second end member of said grating, the second end of said end bar terminating within the building and adjacent a side of the window;

a locking bar mounted adjacent the second end of said end bar, said locking bar being vertically slideable in bushing members attached to the wall of said building;

at least one hook section on said locking bar and extending at substantially right angles to said locking bar to engage the second end of said end bar for preventing the security grating from being opened on its hinges;

a wall mounting bushing attached to the wall of said building at a location below the normal reach of a person reaching through said window, said wall bushing aligned to slideably receive said locking bar; and a quick releasable retaining pin insertable through corresponding holes through said wall mounted bushing and said locking bar for coupling said locking bar to said wall mounted bushing.

2. The security grating locking and release apparatus claimed in claim 1 wherein said grating substantially covers the exterior of a window of a building and wherein the first ends of at least two spaced end bars are loosely coupled to the second end member of said grating and extends through holes into the interior of said building, a section adjacent the second end of said end bars having circumferential notches to engage a bifurcated end on the hooks extending from said locking bar.

3. The security grating locking and release apparatus claimed in claim 2 wherein said hooks on said locking bar are upturned to permit release of said bifurcated end from the notches in said end bars by a vertical dropping of the locking bar.

4. The security grating locking and release apparatus claimed in claim 2 wherein said hooks on said locking bars are downturned to permit release of said bifurcated end from the notches in said end bars by vertically lifting said locking bar.

* * * * *